US005120567A

United States Patent [19]

Frind et al.

[11] Patent Number: 5,120,567

[45] Date of Patent: Jun. 9, 1992

[54] LOW FREQUENCY PLASMA SPRAY METHOD IN WHICH A STABLE PLASMA IS CREATED BY OPERATING A SPRAY GUN AT LESS THAN 1 MHZ IN A MIXTURE OF ARGON AND HELIUM GAS

[75] Inventors: Gerhard Frind, Altamont; Paul A. Siemers, Clifton Park; Stephen F. Rutkowski, Duanesburg, all of N.Y.

[73] Assignee: General Electric Company, Schenectady, N.Y.

[21] Appl. No.: 524,527

[22] Filed: May 17, 1990

[51] Int. Cl.[5] ..... B05D 1/00

[52] U.S. Cl. ..... 427/34; 427/422; 219/121.38

[58] Field of Search ..... 427/34, 191, 422; 219/121.38

[56] References Cited

U.S. PATENT DOCUMENTS 4,805,833 2/1989 Seimers ..... 427/37

4,902,870 2/1990 Frind et al. ..... 427/34

*Primary Examiner*—Shrive Beck

*Assistant Examiner*—Benjamin L. Utech

*Attorney, Agent, or Firm*—James E. McGinness; James C. Davis, Jr.; James Magee, Jr.

[57] ABSTRACT

A low frequency RF plasma spray deposition method is provided, which is especially effective in reducing losses and improving particle heating. In one aspect of the invention, an RF plasma gun is operated in the frequency range below 1 MHz and an argon-helium mixture to which a third component, such as hydrogen, can also be admixed, is substituted for the standard argon-hydrogen mixture used at frequencies above 2 MHz. In another aspect of the invention, a RF plasma gun is operated in the frequency range of 400-500 kHz and specific start up and operating procedures and conditions are set forth for successful deposition of titanium and refractory metal alloys.

10 Claims, 3 Drawing Sheets

30
47
41
44
31
42
36
50
46
46
52
34
45
43
41
63

LOW FREQUENCY PLASMA SPRAY METHOD IN WHICH A STABLE PLASMA IS CREATED BY OPERATING A SPRAY GUN AT LESS THAN 1 MHZ IN A MIXTURE OF ARGON AND HELIUM GAS

BACKGROUND OF THE INVENTION

This invention relates generally to radio frequency (RF) plasma spray deposition devices and particularly to apparatus and methods for deposition at frequency levels of less than about 1 MHz.

Radio frequency (RF) plasma deposition is a plasma spray process which is well known for producing high temperature gaseous plasma. The devices for generating the plasma are sometimes referred to as plasma guns. They find utility in diverse heating applications such as high temperature chemical reactions, heating of solid targets, melting of particles such as a superalloy and for providing surface coatings and spray processes. Plasma processes are also used to produce low interstitial content titanium, refractory metal, as well as the superalloy deposits. In addition, the deposition efficiency of materials sprayed by the RF plasma process can approach 100%.

RF plasma deposition is a plasma spray process which can be used to fabricate low interstitial content titanium, refractory metal, and superalloy deposits. For example, U.S. Pat. No. 4,805,833, the disclosure of which is incorporated herein by reference, describes an RF plasma apparatus, including an RF plasma gun and the operation thereof in a frequency range of from 2 to 5 megahertz. The plasma is produced by induced RF energy which causes gases flowing in the interior of the gun to form a plasma plume or jet which flows to the adjacent substrate.

Efforts to develop techniques for operating RF plasma devices at lower frequency levels were undertaken. It was found that operation of the guns at frequencies less than about 1 MH reduced the ability of the gun to adequately heat a full range of alloys and particle sizes. At low frequency levels, the plasma guns experience difficulty in power coupling to the plasma. In addition, conventional gas mixtures and gun designs which operate well at 2 MHz tend to degrade or crack the quartz tube portion of the gun which encloses the plasma when operated at frequency levels of about 400 KHz.

Accordingly, a need exists for the successful deposition of feed material using RF plasma spray guns with improved particle heating and without the disadvantages experienced with the use of known RF plasma deposition techniques and conditions.

It is an object of this invention to provide a plasma gun operable at low RF frequencies.

SUMMARY OF THE INVENTION

The present invention provides a low frequency plasma spray deposition device which is particularly effective in heating a full range of particle sizes of feed material by providing improved heating characteristics.

Operation of the device can be described as a method for depositing a coating of a selected feed material, e.g., a metal alloy in powder form, on a substrate in the form of a dense adherent layer.

DESCRIPTION OF THE INVENTION

Broadly, the method of the invention is a low frequency plasma spray method for depositing feed material onto a substrate comprises providing a radio frequency plasma spray deposit apparatus, including a tank, a radio frequency plasma gun. means for supplying a gas to the interior of the gun, and a vacuum pump; operating the vacuum pump to reduce the pressure in the tank to a pressure of less than about 500 microns Hg: backfilling the tank to a pressure of about 200- 300 torr with a plasma gas comprising a mixture of argon and helium; providing the gas to the interior of the plasma gun wherein during operation a plasma is formed and at least a portion of the feed material is melted; operating the plasma gun at a frequency range of less than 1 MHz to generate a plasma; and supplying a feed material to the plasma and forming a deposit of the feed material on a receiving surface.

The argon-helium gas mixture which forms the low frequency RF plasma is generally composed of from about 40 to 60 volume percent argon and from about 60 to 40 volume percent helium. However, optimum ratios will depend on various gun design parameters and on the melt characteristics of the feed material, particularly the metal or alloy composition and the size of the particles delivered to the plasma.

Helium volumes as low as about 5 percent can be effective with powder sizes of 50 microns or less. In general, smaller particle size feed materials are effectively melted by plasmas formed by the gas mixture which is predominantly argon.

In another embodiment of the invention, a RF plasma gun is operated in the frequency range of 400-500 kHz. A vacuum pump is used to pump the tank of an RF plasma spray deposit apparatus to below about 500 microns Hg pressure, the tank is then backfilled to a pressure of 20-50 torr with argon gas, and the torch is ignited at 20-50 torr with only argon as the plasma gas. Following ignition, the gun is operated with only argon gas and the tank is allowed to backfill to an operating pressure of 150-350 torr. Once the final operating pressure has been achieved, the torch gas mixture is adjusted to a mixture of argon, helium, and hydrogen. It has been discovered that various argon, helium, and hydrogen mixtures are selectively suitable to melt different materials such as titanium alloys, superalloys, and refractory metals.

In addition, it has been discovered that it is advantageous to use argon as the swirl gas in the gun, and that the helium and hydrogen should be added to the radial flow.

To achieve the proper coupling and operation of the gun, it may be desirable to increase the number of coils in the plasma gun from four to seven. The plate input power of the radio frequency plasma gun is preferably in the range of about 50-100 kilowatts and the flow of hydrogen gas is preferably greater than 5 standard liters per minute. The gun also may have a copper exit nozzle which has been grounded.

BRIEF DESCRIPTION OF THE DRAWINGS

The apparatus and method of this invention will be more clearly understood when taken with reference to the accompanying drawings.

DESCRIPTION OF THE DRAWINGS

Figure 1:
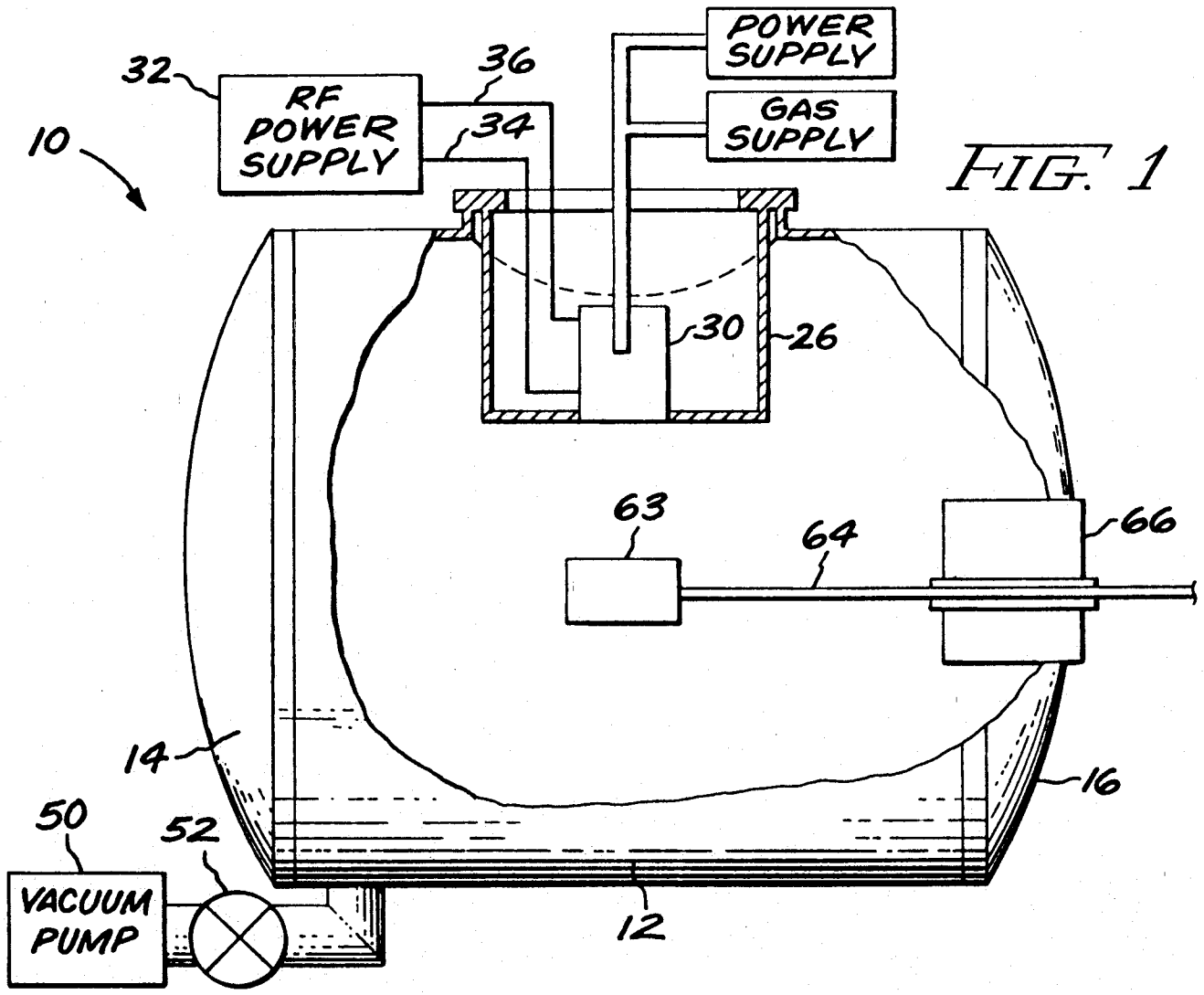
FIG. 1 is a schematic diagram of a system for low frequency RF plasma spray deposition of a feed material onto a receiving surface or substrate.

An illustrative RF plasma deposition system 10 is shown in FIG. 1. The system includes a vacuum tank 12 having end sections 14 and 16, one or both of which may be removable. Plasma gun 30, vacuum pump 50, and vacuum valve 52 are shown generally.

Tank 12 is provided with a gun-mounting vessel 26, usually of cylindrical configuration, which projects into the vacuum tank through a vacuum sealed orifice. The plasma gun is connected to a RF power supply 32 by leads 34 and 36. The plasma gun is usually provided with a coolant, usually water, supplied by a coolant circuit, not shown.

The plasma gun is conventionally provided with a plasma or torch gas supply system, not shown, which includes gas storage tanks for one or more gases, valves for adjusting both choice of gas and flow rates for the individual gases to be used in forming the plasma.

In the device illustrated in FIG. 1, the plasma generated by the plasma gun 30 is directed towards the surface of a substrate or target 63 positioned within the tank. The plasma heats the surface of the substrate or target and melts the particles of feed material, e.g., superalloy in powder form. The now molten droplets are sprayed onto the surface of the substrate where they coalesce and solidify to form the coating.

Figure 2:
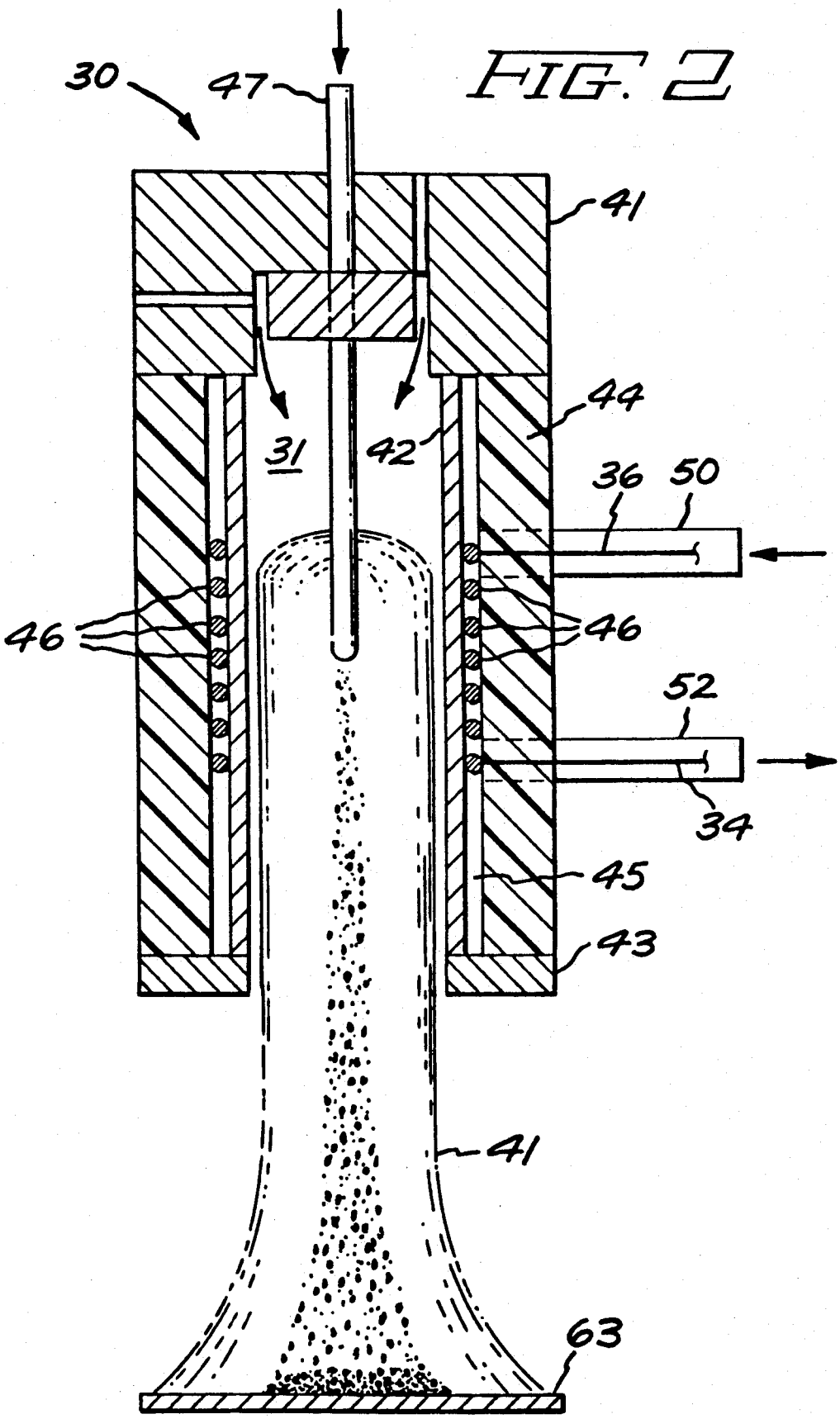
FIG. 2 is a schematic representation of some of the details of plasma gun useful in the system of FIG. 1.

A schematic representation of a plasma gun suitable for use in the device of FIG. 1 is shown in FIG. 2. A gun of this type would be mounted in vessel 26 so that the plasma plume 41 extends into tank 12 towards target 63. Plasma gun 30 is of generally circular cross sectional configuration having a closed end and an open end communicating with the interior of tank 12.

As illustrated, gun 30 has a top metallic member 41 connected to a quartz inner wall 42, and to an electrically non-conductive outer wall 44, which in combination define a chamber 45 therebetween. Member 43 seals chamber 45 and connects quartz wall 42 and outer wall 44, as shown. The windings of RF coil 46 disposed within chamber 45 are connected to the RF supply of FIG. 1 via leads 34 and 36. Conduits 50 and 52 adapted to carry both current and coolant by means can be recognized in the art. Chamber 45 is also in communication with a coolant supply, not shown, via conduits 50 and 52 so that it is filled with flowing coolant which is in direct contact with the inner surface of quartz wall 42 and with coil 46. Arrows indicate the preferred direction of water flow. Power leads 34 and 36 of FIG. 1 are connected to coil 46.

Water cooled material injection means 47 passes through member 41 into the plasma chamber 31 of plasma gun 30 and comprises a central conduit for material feed flow and concentric conduits for in-flow and out-flow of coolant, e.g., water. A tubular insulating member 44 is concentrically disposed about coil 46 and quartz wall 42. Insulating member 44 can be of a material such as polytetrafluoroethylene or the like.

Figure 3A:
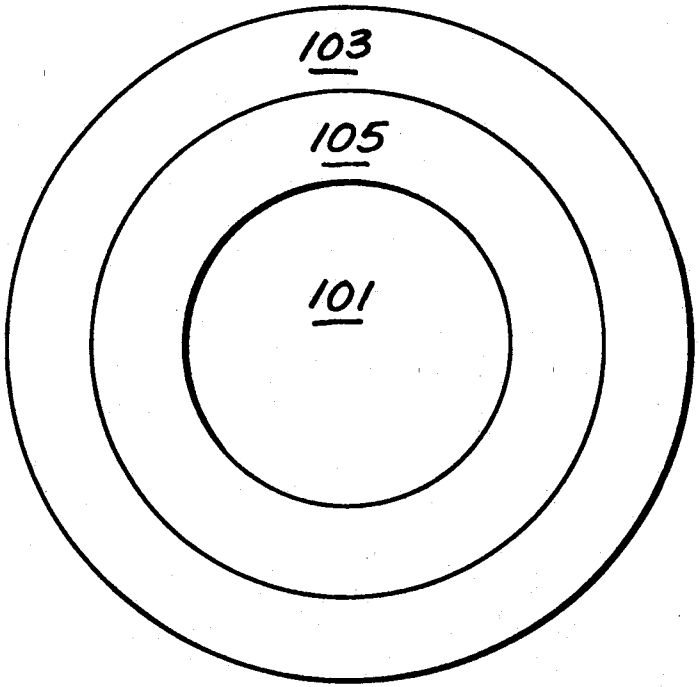
FIG. 3A is a horizontal section along the line A—A' of FIG. 3.
Figure 3:
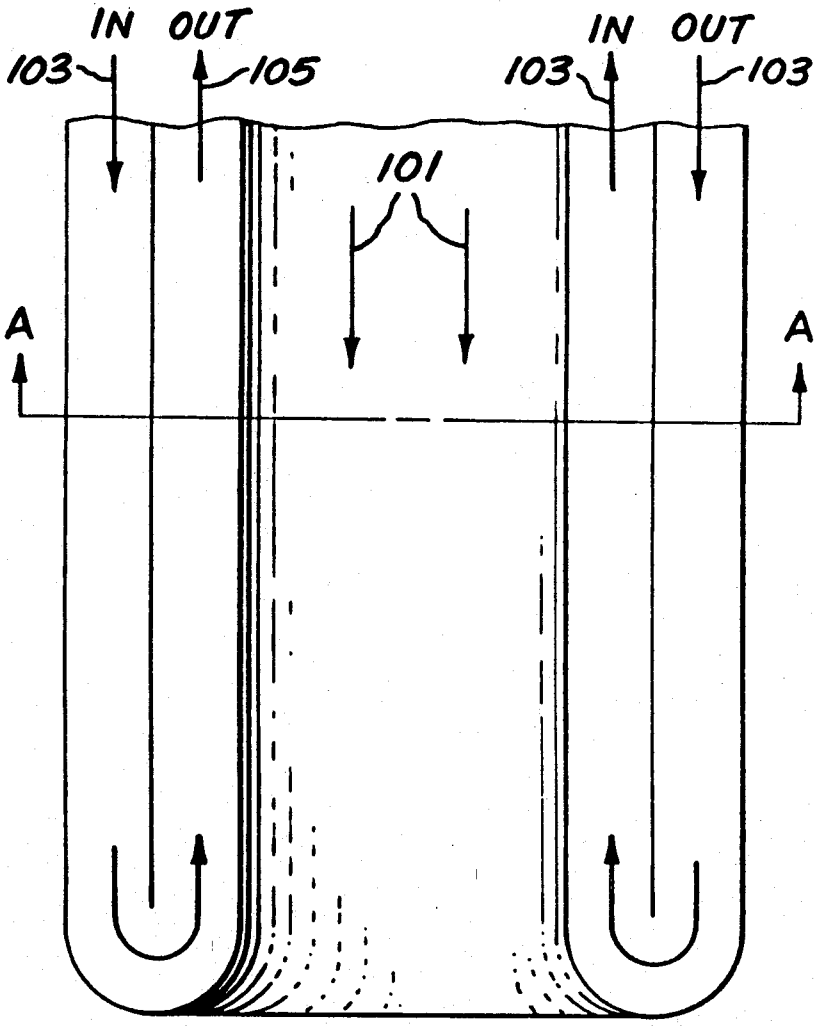
FIG. 3 is a vertical section diagram of a water-cooled particle injection tube.

Water-cooled particle injection means 47 is further illustrated by FIGS. 3 and 3A. Central conduit 101 is in communication with the powder source, including carrier gas, of FIG. 1. Coolant circuit direction is shown by arrows 103 and 105.

FIG. 3A is a section across line A—A' of injection means 47 showing inner conduit 101 and coolant circuit portions 103 and 105.

Referring again to FIG. 1, the target 63 is carried by a mechanical actuator 64 which permits positioning in relation to the plasma gun. of the target, e.g., by rotation or other form of manipulation by mechanism 66. In simple terms, the actuator means can be described as a rotatable and slidable mandrel. Manipulator mechanisms for simple or complex shaped substrates are known in the art and are constructed according to recognized mechanical techniques, depending on the shape and dimensions of the target.

The plasma gun 30, as described, is similar to a commercially available plasma gun manufactured by TAFA Corporation of Concord, N.H. U.S.A., such as the TAFA Model 66 plasma torch. However, extensive alterations to the set-up and operating procedure of the commercially available guns are possible, in accordance with the present invention, to allow the start up, operation, and deposition of titanium superalloys, refractory alloys on ceramics at low operating RF frequencies, e.g., 400–500 kHz.

Operation of gun at frequencies less than 1 MHz leads to the degradation in the gun's ability to feed stream particles. In addition, problems of power coupling to the plasma are experienced in frequency ranges lower than 1 MHz, especially when operated with molecular gases, such as hydrogen, nitrogen, and oxygen or with argon-hydrogen mixtures.

In order to use RF plasma guns in the frequency range below 1 MHz, it has been discovered that an argon-helium mixture should be used in place of the standard argon-hydrogen mixture. A third component, such as hydrogen, can also be admixed with the argon-helium gas mixture.

An argon-helium mixture provides superior results for a number of reasons. Argon alone is not effective for heating and melting powders other than very fine powders. Argon-hydrogen mixtures are more effective at low frequencies; but the plasma is unstable at hydrogen levels above about 1 percent, by volume. Instability of the plasma results in failure of the quartz tube. The admixture of helium, even in substantial amounts with argon, provides a plasma of sufficient heating capability and stability to melt powders. In general, while any amount of helium improves heating capability, 20 to 90 percent, by volume, helium is broadly preferred. A more preferred range of gas composition is from about 40 to about 60 volume percent helium, the balance being argon and optionally up to about 6 volume percent hydrogen. An optimum gas mixture has been found to comprise about 57 percent helium, 37 percent argon, and about 6 percent hydrogen.

Moreover, with the use of an argon-helium mixture, molecular gases such as hydrogen, nitrogen, and oxygen may be added without causing power coupling problems by changing the gas mixtures to contain one or more of such molecular gases, the heating characteristics of the basic plasma gas may be suitably altered.

Table 1 below sets forth the conditions for low frequency operations in accordance with another embodiment of the invention. Operation at 400 kHz does not require the use of a curtain gas to prevent strikeover. Any arcing within the tank can be eliminated by grounding the copper exit nozzle of the gun. Operation at 2 MHz requires the use of a curtain gas, and isolation of the plasma gun from the grounded tank by use of an insulating plate between the gun and the tank. In contrast, through the use of a specific range of gas flow rates and mixtures and specific modifications to the plasma gun set up and its operating procedure, one may successfully deposit titanium and refractory metal alloys at operating frequencies of 400-500 kHz without the use of a curtain gas or the isolation of the plasma gun from the grounded tank.

Operation at 400 Hz also requires the use of an argon-helium-hydrogen gas mixture. In a series of experiments, it has been found that simple argon-hydrogen mixtures which work for high frequency operation result in plasma instabilities (bending or cocking of the jet) which could lead to failure of the fused silica tube wall. The argon-helium-hydrogen mixture shown in Table 1 minimizes the total gas flow required for stable operation of the torch while still achieving the melting obtained when a higher frequency was used. During operation of the torch, e.g., at 400 kHz, the helium and hydrogen secondary gases can be injected into the radial flow instead of the swirl flow.

TABLE 1

LOW FREQUENCY OPERATING CONDITIONS FOR TITANIUM ALLOY DEPOSITION

| | | |
|---|---|---|
| Power | | |
| Frequency | | 400 kHz |
| Coil Turns | | 7 |
| Plate Voltage | | 7.8 kV |
| Plate Current | | 10.75 Amperes |
| Input Plate Power | | 84 kw |
| Gas Flow (slm) | | |
| Swirl | Ar | 16 |
| Radial | Ar | 70 |
| Radial | He | 148 |
| Radial | $H_2$ | 3.6 |
| Powder Feed | He | 4.5 |
| Tank Pressure | | 250 torr |

At 400 kHz it has also been determined that for hydrogen flows exceeding 4-5 slm, it was necessary to increase the plate input power from about 80 kw to as high as 100 kw to prevent arc extinction. It is believed that the lower frequencies and large percentages of secondary gas flows such as hydrogen and helium couple to the plasma less efficiently, hence more power is required to maintain the arc. To improve the coupling at 400 kHz, the number of gun coils can be increased from four to seven.

At 2 MHz the gun can be started at atmospheric pressure if only argon gas is used. At 400 kHz it was learned that ignition was easier at low pressures, but at pressures in the 10 torr range a glow type discharge would be initiated which could damage the fused silica tube wall. It has been found that ignition at 20-50 torr is optimum. The pressure is sufficiently low to allow easy ignition of argon, but sufficiently high to prevent generation of a glow type discharge.

What is claimed is:

1. A method of operating a radio frequency plasma spray apparatus comprised of a tank, a radio frequency plasma gun, means for supplying a gas for swirl flow to the interior of the gun, means for supplying a gas for radial flow to the interior of the gun, means for supplying a feed material to the interior of the gun, and a vacuum pump; the method comprising:

evacuating the tank and backfilling to a pressure of about 20 to 50 torr with a gas consisting essentially of argon;

providing the gas to the interior of the plasma gun through the swirl gas supply means and the radial gas supply means;

operating the plasma gun at a frequency range of about 1 MHz or less to generate a plasma in the gun;

backfilling the tank to increase the pressure to about 150 to 350 torr; and introducing into the plasma gun a second gas comprising a mixture of argon and helium through the gas supply means and maintaining a pressure of about 150 to 350 torr in the tank.

2. The method of claim 1 further comprising the step of supplying a feed material to the plasma in the gun to cause at least a portion of the feed material to be melted and deposited on a receiving surface.

3. The method of claim 2 wherein the feed material is selected from the group consisting of titanium base alloys, nickel base superalloys, iron base superalloys, refractory metal alloys, and ceramics.

4. The method of claim 1 wherein the radio frequency plasma gun includes a helical coil containing at lest seven windings.

5. The method of claim 1 wherein the second gas is further comprised of hydrogen.

6. The method of claim 5 wherein the second gas is comprised of up to about 6 volume percent hydrogen, about 40 to 60 volume percent argon, and about 40 to 60 volume percent helium.

7. The method of claim 5 wherein the swirl gas supply means provides argon gas at a rate of about 16 standard liters per minute.

8. The method of claim 5 wherein the radial gas supply means provides argon gas at a flow rate of 70 standard liters per minute, helium gas at a flow rate of 148 standard liters per minute, and hydrogen gas at a flow rate of 3.6 standard liters per minute.

9. The method of claim 5 wherein the plate input power of the radio frequency plasma gun is in the range of 80-100 kilowatts and the flow of hydrogen gas is greater than 5 standard liters per minute.

10. The method of claim 1 wherein the radio frequency plasma gun has an exit nozzle made from copper, which nozzle has been grounded.

* * * * *